US012569109B2

(12) United States Patent
Comina et al.

(10) Patent No.: US 12,569,109 B2
(45) Date of Patent: Mar. 10, 2026

(54) DISHWASHER FOR TREATING WASHWARE

(71) Applicants: Electrolux Professional S.p.A., Pordenone (IT); Alma Mater Studiorum—Universita' di Bologna, Bologna (IT)

(72) Inventors: Andrea Comina, Pordenone (IT); Andrea Omichini, Bologna (IT); Andrea Agiollo, Bologna (IT)

(73) Assignee: Electrolux Professional S.p.A., Pordenone (IT)

( * ) Notice: Subject to any disclaimer, the term of this patent is extended or adjusted under 35 U.S.C. 154(b) by 49 days.

(21) Appl. No.: 18/442,855

(22) Filed: Feb. 15, 2024

(65) Prior Publication Data

US 2024/0298870 A1 Sep. 12, 2024

(30) Foreign Application Priority Data

Mar. 8, 2023 (EP) ..... 23160750

(51) Int. Cl.
*A47L 15/42* (2006.01)
*A47L 15/00* (2006.01)

(52) U.S. Cl.
CPC ..... *A47L 15/4295* (2013.01); *A47L 15/0023* (2013.01); *A47L 15/0026* (2013.01);
(Continued)

(58) Field of Classification Search
CPC ..... A47L 15/0021; A47L 15/0023; A47L 15/0026; A47L 15/0028; A47L 15/0034;
(Continued)

(56) References Cited

U.S. PATENT DOCUMENTS

2014/0083460 A1* 3/2014 Mcdonald ..... A47L 15/0047 134/57 D

FOREIGN PATENT DOCUMENTS

CN 111265166 A * 6/2020 ..... A47L 15/46
CN 115568796 A 1/2023
(Continued)

OTHER PUBLICATIONS

Machine translation of CN111265166A (Year: 2020).*
(Continued)

*Primary Examiner* — Douglas Lee
(74) *Attorney, Agent, or Firm* — Stites & Harbison, PLLC; David W. Nagle, Jr.

(57) ABSTRACT

A dishwasher (100) and a method for treating washware, where the dishwasher (100) comprises a washing cavity (110) configured to receive washware (200), a rack (120) removably inserted in the washing cavity (110), and a washware recognition system (300) configured to detect a washware characteristics (310) for each washware (200) in the washing cavity (110). The washware recognition system (300) comprises two image capturing devices (320, 330) capturing at least one first, second and third image (321, 331, 332) of the washware in the rack (120), a neural network (340) configured to, based on the at least one first (321), second (331) and third images (332), determine a washware characteristics (310), and a control unit (360) configured to evaluate the washware characteristics (310) and determine a washware treatment cycle (350) based on the washware characteristics (310).

8 Claims, 7 Drawing Sheets

(52) U.S. Cl.
CPC ..... *A47L 15/0028* (2013.01); *A47L 15/0034* (2013.01); *A47L 15/0055* (2013.01); *A47L 2401/04* (2013.01); *A47L 2501/01* (2013.01); *A47L 2501/06* (2013.01); *A47L 2501/07* (2013.01); *A47L 2501/11* (2013.01); *A47L 2501/30* (2013.01)

(58) Field of Classification Search
CPC ..... A47L 15/0055; A47L 15/4295; A47L 2401/04; A47L 2401/30; A47L 2501/01; A47L 2501/06; A47L 2501/07; A47L 2501/11; A47L 2501/30
See application file for complete search history.

(56) References Cited

FOREIGN PATENT DOCUMENTS

| | | | | |
|---|---|---|---|---|
| KR | 2022036064 | A | * | 3/2022 |
| WO | 2018/044094 | A1 | | 3/2018 |

OTHER PUBLICATIONS

Machine translation of KR2022-0036064A (Year: 2022).*
European Patent Office, European Search Report issued in corresponding Application No. 23160750.8 dated Sep. 1, 2023.

* cited by examiner

DISHWASHER FOR TREATING WASHWARE

TECHNICAL FIELD

The present disclosure relates to the technical field of electronically programmable dishwashers, and more precisely to a method for activating a treatment of washware inside said type of dishwasher.

BACKGROUND

Most dishwashers nowadays are electronically programmable, meaning that they include an electronic control unit containing a range of pre-set washing cycles for treating washware inside the washing machine. The electronic control unit is configured to process inputs from various sensors inside the washing machine as well as inputs from a user operating the washing machine.

The electronically programmable dishwasher is usually provided with the possibility for a user to choose among more than one different pre-set washing programs. The availability of the pre-set washing programs is to give the user a possibility to choose a program that it is most suitable for the washware to be treated.

The washware can differ by type, for example dishes, glasses, cups or cookware. The washware can also differ by material, for example metal, plastic, ceramic or glass. There is a correlation between the type and material of the washware, and the optimal treatment of said washware.

Pre-set washing programs are often characterized by duration of program length, temperature of washing liquids, and the amount of washing liquids. However, pre-set programs are often designed to treat the washware based on one of the features type and material.

Further, the pre-set programs are selected by the user and the right selection, the correspondence between type and material of washware and program, relies on the user's knowledge and awareness. A wrong selection of pre-set program may lead to a wrong treatment of the washware. A wrong treatment may result in an unsatisfactory result, i.e. the dirt is not completely removed, or damage of the washware, i.e. the glasses become opaque. Further, a non-optimal choice of pre-set washing program may lead to a redundant consumption of energy and materials, i.e. the washing cycle needs to be repeated.

SUMMARY

In view of at least the above-identified drawbacks, the inventors have reached the insight that there is a need for an electronically programmable dishwasher able to, in an automatic way, identify the washware inside the washing machine, provide this information to a washware recognition system, and activate a suitable washware treatment program. The present disclosure provides a dishwasher with a washware recognition system and a method for treating washware using a dishwasher of the same type in the independent claims that at least partially mitigates the above-mentioned drawbacks. Preferred embodiments are defined in the dependent claims.

Hence, according to a first aspect of the invention, there is provided a dishwasher for treating washware, comprising a washing cavity configured to receive washware, a rack removably inserted in the washing cavity, and configured to hold said washware. The dishwasher further comprises a washware recognition system configured to detect a washware information for each washware in the washing cavity.

The washware recognition system comprises a first image capturing device capturing at least one first image of the washware in the rack, a second image capturing device capturing at least one second image and at least one third image of the washware in the rack, and a neural network configured to, based on the at least one first, second and third images, determine a washware characteristics. The dishwasher also comprises a control unit configured to evaluate the washware characteristics and determine a washware treatment cycle based on the washware characteristics.

According to a second aspect of the invention, there is provided a method for treating washware using the dishwasher according to the first aspect of the invention. The method comprises the step of loading the rack with washware. The method further comprises the step of capturing at least one first image of the washware in the rack using the first image capturing device. Further, the method comprises capturing at least one second image of the washware in the rack using the second image capturing device. The method further comprises the step of heating the washware in the rack using a heating medium at a predetermined temperature for a predetermined amount of time. The method further comprises the step of capturing at least one third image of the washware in the rack using the second image capturing device. Further, the method comprises determining, a washware characteristics. The method further comprises the step of determining based on the washware characteristics, a washware treatment cycle. The method further comprises treating the washware in the washing cavity according to the determined washware treatment cycle.

By the term "washware" is herein meant the articles to be treated by the dishwasher. The washware may be divided into type and material. The type of washware may for example be dishes, soup bowls, glasses, cups, mugs, cookware, pans or pots. Other types of washware not mentioned here are also possible. The material of the washware may for example be glass, plastic, metal, wood and ceramics. Other materials of washware not mentioned here are also possible. Further, the characterizing features (type, material) of the washware may not be independent from each other. There may for example be a correlation between the type and material.

By the term "washware treatment cycle" is herein meant a program to treat the washware inside the dishwasher in a sequence of phases having a start and an end. A phase may be a temporal frame in which the dishwasher executes one or more operations. An operation may be the activation and the managing of for example a washing circuit, a rinsing circuit, a drying circuit, etc. of the dishwasher. A dishwasher may allow the execution of programs as well as the configuration of programs and the configuration of operations. The dishwasher may for example be managed by a control unit that processes the inputs from sensors and/or inputs from a washware recognition system, to execute the programs. The control unit may keep settings and values that are used to configure programs and operations in memory. The configuration of the programs may be characterized by different timings in operation execution, different set points for the temperature of liquids and different set points for the quantity of liquids. The ability to configure the programs yields the possibility to choose a program that is as much as possible suitable for the washware that is to be treated.

By the term "washware recognition system" is herein meant an algorithm developed to receive information about the washware, and based on that information, be able to classify the washware into a set of washware characteristics. The washware characteristics may for example be the type and material of the washware. The washware recognition system may for example be a neural network. However, other types of algorithms suitable for classifying washware given the same type of information are possible. For example, the image recognition system may be an artificial neural network, a convolutional neural network or a recurrent neural network. Other types of machine learning models, deep learning models or other image recognition models are also possible. The information about the washware may for example be a data set including images or text.

The "control unit" may be any type of control unit. It may for example be a central processing unit embedded in the dishwasher and connected to the sensors and algorithms used in the dishwasher.

Thus, there is provided a dishwasher and a method for treating washware in the dishwasher with the function to provide an automatic way to identify the washware inside the dishwasher by their characteristics, provide this information to a washware recognition system, and activate a suitable washware treatment program. By allowing for an automatic identification of the characteristics of the washware and selection of a washware treatment program, the problem of mistreating washware can be mitigated. Further, the need for a user to manually select and choose a pre-set washware treatment program no longer exists. Thus, the need for a user to have some type of knowledge about the treatment preferred for a certain washware or a mix of different washware, is also reduced.

The dishwasher in the present invention comprises a washing cavity configured to receive washware. The washing cavity is further configured to hold a rack with washware. The washing cavity may hold one or more racks with washware, arranged in one, two or more levels. The cavity may be partly sealed such that liquids are prevented from leaving from the dishwasher. The liquids may for example be liquids to treat the washware, for example water, liquid detergent, etc. The cavity may further comprise a draining system configured to drain the liquids after the washware treatment cycle is finished. The cavity may have a square or rectangular shape, or any other shape suitable for holding a rack with washware.

The rack may be a type of tray or basket with compartments, partitions or regions adapted to hold different types of washware. The rack may have a shape conforming with the shape of the cavity. For example, the shape of the rack may be square or rectangular. The rack may be removably inserted into the cavity, such that the dishware can be loaded in the rack and then inserted into the cavity. When the washware is treated, the rack may be removed from the cavity and emptied. There are also other situations where the rack may be inserted or removed, for example if the rack is only partly filled during loading, and then inserted into the cavity without the washware treatment cycle being started, and then removed again to fill the rack with more washware, etc. The rack may be removably inserted into the cavity by means of guiding rails, for example. The rack may be manually loaded and unloaded with washware by a user, for example. There may be other, automatic ways to load the rack as well.

According to an embodiment, the dishwasher further comprises a closing, the closing being switchable between at least two states: an open state configured to provide access to the washing cavity and a closed state configured to close the washing cavity. This may ensure that the washing cavity is sealed once the rack is inserted into the cavity and the washware treatment cycle is prepared to start. In some examples, the closing is a door. In other examples, such as in a conveyor dishwasher, the closing is a curtain. Other types of closings are also possible, such as a hatch or a sliding door. The closing may be opened by means of a handle attached to the closing. The closing may for example be arranged on the dishwasher by means of hinges or a similar structure.

Further, the dishwasher comprises a washware recognition system configured to detect a washware information for each washware in the washware cavity. The washware recognition system comprises a first image capturing device capturing a first picture of the washware in the rack. The first image capturing device may be arranged in a position such that the captured image contains the entire rack.

According to an embodiment, the first image capturing device is configured to capture the at least one first image in a visible light spectrum. The first image capturing device may therefore capture an image of the washware in the rack, where for example the different types of washware and the number of washware loaded in the rack may be identified. This is advantageous in that the first image may contain enough information to determine the washware by their characteristics, such as material and type. The first image capturing device may be placed inside the washing cavity. The first image capturing device may also be placed outside of the washing cavity, and capture a first image of the washing cavity through a window or similar.

According to an embodiment, the dishwasher further comprises a lighting device configured to at least partly illuminate the washing cavity, such that a first image can be captured. This is advantageous in that the first image capturing device may capture an image of the washware in the rack in the case where the closing is in a closed position. The lighting device may be placed inside the washing cavity. The lighting device may be connected to the closing, such that the lighting device is automatically turned on once the closing is in the closed state. The lighting device may be a lamp, for example an LED lamp, or any other type of lamp.

According to an embodiment, the second image capturing device is configured to capture the at least one second image and the at least one third image in an infrared light spectrum. Thus, the at least one second image may contain information about an initial temperature of the washware in the rack, and the at least one third image may contain information about the temperature of the washware in the rack after providing it with a predetermined amount of energy via the heating medium. The initial temperature may for example be the temperature of the washware right after it has been loaded in the rack. This is advantageous in that the second and third images may contain information about the thermal capacities of the washware. This is advantageous in that the second and the third images may contain enough information to determine the washware by their characteristics, such as the thermal capacity of a material comprised by the washware. This allows the material of the washware to be identified. The second image capturing device may be placed inside the washing cavity. The second image capturing device may also be placed outside of the washing cavity, and capture a second image of the washing cavity through a window or similar.

According to a further embodiment, the first and second image capturing devices are arranged to capture a first and second image of the washware in the rack inside the washing cavity in both the open state of the closing and the closed state of the closing. This is advantageous in that the washware recognition system is independent of the state of the closing.

According to an embodiment, the first and second image capturing devices are cameras. The first and second image capturing devices may be two separate cameras, or combined in one single camera. This is advantageous in that the captured images may be formatted in a standardized format. The images may be represented in pixels. Further, the use of cameras may enable a more flexible solution, since conventional cameras may be used. This may also facilitate reparation and exchange of the first and second image capturing devices, since the devices does not have to be custom-made for a specific application.

Further, the washware recognition system comprises a neural network configured to, based on the first, second and third images, determine for each washware, a washware characteristics. The neural network may be an artificial neural network, a convolutional neural network or a recurrent neural network, for example. Other types of machine learning models, deep learning models or other image recognition models are also possible. The neural network may receive one or more instances of the first, second and third images as input. As described in the second aspect of the invention, a first image in the visual spectrum is captured, along with a second image captured in the infrared light spectrum being captured before the start of heating the washware in the rack with a heating medium at a predetermined temperature for a predetermined amount of time. Furthermore, a third picture captured in the infrared light spectrum is captured after the end of the heating of the washware in the rack with a heating medium at a predetermined temperature for a predetermined amount of time.

In the neural network, a comparison between the input images may be made pixel per pixel. For the images in the infrared light spectrum, this may mean that a comparison is made between the colour of the pixels in the at least one second image before the heating operation and the colour of the pixels in the at least one third image after the heating operation. For example, in an infrared image, the colours may represent a temperature of the captured objects in the image. Therefore, each colour difference in the image may represent a temperature difference of the washware in the dishwasher cavity. Further, a difference in colour between the pixels of the at least one second image and the at least one third image may represent a difference in temperature of the washware due to the heating operation of the washware. The comparison between the at least one second image and the at least one third image may be used to determine a thermal capacity of the washware materials and therefore determine the material of the washware.

Therefore, the analyzed pixels from the at least one second image and the at least one third image may be associated and overlapped with the pixels in the image captured in the visible light spectrum. The pixels in the first image captured in the visible light spectrum may represent the type of washware in the cavity, such that the washware may be identified according to type and/or material. The output of the neural network may therefore be a categorization of each washware identified in the captured images. The washware may be categorized according to a washware characteristics.

According to an embodiment, the washware characteristics comprises information about a type of the washware. The type of washware may for example be a glass, a plate, a mug, a pot, a pan, cutlery, etc. The washware may be of other types than the previously listed. Different types of washware may require different types of treatment. For example, a pot may need a different type of treatment than a mug to be sufficiently cleaned. By classifying the washware by type, this information may be utilized by the dishwasher when choosing the washware treatment cycle. This embodiment is thus advantageous in that the type of washware may determine what washware treatment cycle that is best suited for a washware.

According to an embodiment, the type of washware is at least partly associated with a predetermined washware treatment cycle. The washware recognition system may be built with prior knowledge about different types of washware and their corresponding optimal washware treatment cycle. The same knowledge may then be used after classification of the washware, such that the type of washware may be used to determine the washware treatment cycle. Each type of washware may be associated with a predetermined washware treatment cycle. Alternatively, each washware type may be associated with one or more washware treatment cycles suitable for that type of washware. Furthermore, the type of washware may be associated with a parameter included in the washware treatment cycle, such that a threshold of that parameter is not overridden in the washware treatment cycle of the specific type. For example, a washware may be classified as a mug, and a parameter included in the washware treatment cycle may for example be a temperature. The mug may then be associated with a temperature threshold of 60° Celsius, such that only washware treatment cycles including temperatures of 60° Celsius or below are associated with washware of the type mug. This is advantageous in that a user using the dishwasher does not need to possess this knowledge themselves. Instead, the user may rely on the dishwasher determining the optimal washware treatment cycle based on the washware loaded in the washware cavity. A further advantage is that choosing the washware treatment cycle partly based on a type of washware enables resource savings since the washware is classified and a washware treatment cycle is chosen each time the dishwasher is used. This enables more efficient use of both water and detergent. A further advantage is that it enables minimizing the wear on the washware, enabling a longer lifetime of said washware. It also mitigates the risk of destroying washware due to improper treatment thereof.

According to an embodiment, the washware characteristics comprises information about a material of the washware. Different washware materials may require different types of treatment.

According to another embodiment, the material of the washware comprises at least one of glass, plastic, ceramic, wood, metal. For example, glass may need a different type of treatment than wood to be sufficiently cleaned. Wood as a material may for example not absorb as much heat as glass, and therefore may not need to be treated with as warm temperatures as glass may need. By classifying the washware by material, this information may be utilized by the dishwasher when choosing the washware treatment cycle. This embodiment is thus advantageous in that the washware material may determine what washware treatment cycle that is best suited for a washware. A further advantage is using the information regarding the washware material also helps preserve the material, since a washware treatment cycle as gentle as possible on the material can be chosen with this information.

According to an embodiment, the material of the washware is at least partly associated with a predetermined washware treatment cycle. The washware recognition system may be built with prior knowledge about different washware materials and their corresponding optimal washware treatment cycle. The same knowledge may then be used after classification of the washware, such that the washware material may be used to determine the washware treatment cycle. Each washware material may be associated with a predetermined washware treatment cycle. Alternatively, each material may be associated with one or more washware treatment cycles suitable for that material. Furthermore, the material may be associated with a parameter included in the washware treatment cycle, such that a threshold of that parameter is not overridden in the washware treatment cycle of the specific material. For example, a washware may be classified as being of the material ceramics, and a parameter included in the washware treatment cycle may for example be a temperature. The material ceramics may then be associated with a temperature threshold of 40° Celsius, such that only washware treatment cycles including temperatures of 40° Celsius or below are associated with washware of the material ceramics. This is advantageous in that a user using the dishwasher does not need to possess this knowledge themselves. Instead, the user may rely on the dishwasher determining the optimal washware treatment cycle based on the washware loaded in the washware cavity. A further advantage is that choosing the washware treatment cycle partly based on a washware material enables resource savings since the washware is classified and a washware treatment cycle is chosen each time the dishwasher is used. This enables more efficient use of both water and detergent. A further advantage is that it enables minimizing the wear on the washware, enabling a longer lifetime of said washware. It also mitigates the risk of destroying washware due to improper treatment thereof.

Furthermore, the combination of the type and material of the washware may be associated with a predetermined washware treatment cycle. The type of washware in combination with the material of the washware may be used by the washware recognition system to determine what type of treatment suits best for the identified washware loaded in the washware cavity. The correlation of the type and material of a washware may determine how the washware should best be treated. For example, a wine glass made of glass may require a different treatment than a wine glass made of ceramics. The wine glass made of ceramics may be more sensitive to higher temperatures than the wine glass made of glass.

According to an embodiment, the washware characteristics is at least partly determined based on a temperature increase of each heated washware in the rack, as a result of heating the washware in the rack with a heating medium at a predetermined temperature for a predetermined amount of time. Information regarding the temperature increase of a material may be important since it entails information about how much a material or washware absorbs in terms of heat. Thus, it may entail information about what a material may endure in terms of heat in a washware treatment cycle. The washware recognition system may be built with prior knowledge regarding the temperature level or heat absorption capacities of various materials. The washware recognition system may therefore utilize this knowledge when receiving and analyzing the images. Prior knowledge regarding the heat radiation or absorption of different materials may be used as a method to classify the washware captured in the images. For example, the material wood may absorb less heat than the material metal, and the washware recognition system may therefore know that a material with a temperature level less than a specific value is likely not metal, but instead a material with lower heat capacity, as for example wood. This embodiment is advantageous in that different materials absorbs different amounts of heat, why it is a reliable method to use to help determine the material of the washware loaded in the washware cavity. Furthermore, the temperature level is captured by the images taken in the IR light spectrum, why the images fed to the washware recognition system contains this information.

According to a further embodiment, the temperature increase is determined by comparison of the at least one second image and the at least one third image. The at least one second picture is captured prior to heating of the washware inside the cavity. The at least one third image is captured after the heating of the washware inside the cavity. As previously discussed, the images may be compared pixel by pixel. For example, if a pixel from the at least one second image is compared to the same pixel from the at least one third image, they may have different colours in the infrared light spectrum. The colour of the pixel may be used to determine the temperature level of the object partly represented by said pixel. Further, the temperature of the washware after the heating of the washware inside the cavity may give information about the type and/or material of the washware objects inside the cavity.

Further, it may be difficult to determine the material of a washware only analyzing an image taken in the visible light spectrum. For example, a plate may be made of a transparent glass material, and therefore be difficult to identify in an image taken in the visible light spectrum. Therefore it is advantageous to combine images taken in the visible light spectrum with at least one image taken in the infrared light spectrum. This is advantageous since it enables an increased ability to determine the material of a washware. Further, only analyzing images taken in the IR light spectrum, may increase the difficulty of determining the type of washware, since the IR light spectrum image shows a temperature level of the washware, and not necessarily distinct contours. It is therefore advantageous to combine the different types of images in order to fully analyze the washware in the washware cavity.

According to an embodiment, the heating medium is water or air being supplied to the washing cavity for a predetermined amount of time, the water or air having the predetermined temperature. Put another way, the washware is provided with a predetermined amount of energy. The predetermined temperature and the predetermined amount of time may be set by the supplier of the dishwasher, such that it remains the same during the lifetime of the dishwasher. The predetermined temperature may for example be set in Celsius, Kelvin, or in any other suitable unit. The predetermined amount of time may for example be seconds, minutes or hours or any other suitable time unit. The water or air may be supplied into the washware cavity by means of nozzles reaching into openings in the washware cavity. The water or air may be preheated to the predetermined temperature before entering the washware cavity. In this way, the washware may be provided with a predetermined amount of energy based on the predetermined temperature in combination with the amount of time. There may be one or more nozzles for supplying the air or water, such that all washware is reached. The air may be humid air or steam. An advantage with using air is that the water usage may be reduced. Also, air may be more gentle on the washware. An advantage with using water is that the heated water may be reused in the washware treatment cycle in a later stage.

According to an embodiment, the washware treatment cycle comprises a set of parameters determined by the control unit, the parameters including at least one of the following: a time duration of the washware treatment cycle, a temperature of a washing liquid, a temperature of a rinsing liquid, a temperature of a drying medium, a time duration of a drying cycle, an amount of detergent, and an amount of washing liquid. The time duration of the washware treatment cycle may be the total time duration from a user indicating that a washware treatment cycle should be started until the washware is dried and the dishwasher ready to be emptied. The start of the washware treatment cycle may be defined as including the washware recognition process, i.e. the including the time it takes to capture the images, identifying the washware and choosing the appropriate washware treatment cycle. Moreover, the temperature of the washing liquid may be the temperature of the water supplied to the cavity to clean the washware. The temperature of the washing liquid may also be the temperature of the mix between the water and the detergent used to clean the washware in the cavity. Further, the temperature of the rinsing liquid may be the temperature of the water used to rinse the washware in the cavity after being cleaned with detergent. The temperature of the drying medium may be the temperature of the air supplied to the cavity in order to dry the washware therein after cleaning. The time duration of the drying cycle may be a time interval included in the washware treatment cycle allocated for drying the washware in the cavity. The amount of detergent may be an amount of detergent sufficient to clean the washware loaded in the cavity. Furthermore, the detergent may for example be a liquid detergent, powder detergent or tablet detergent. The amount of washing liquid may be the volume of the mixture between detergent and washing liquid. The washing liquid may for example be water. This embodiment is advantageous in that there are several parameters that may be used to create a washware treatment cycle. The more parameters, the more unique programs are able to be created, and thus the likelihood of a program suiting a washware in the washware cavity is increased.

According to an embodiment, the washware in the rack is a plurality of washware having different washware characteristics, and wherein the washware treatment cycle is determined based on the washware characteristics associated with the washware treatment cycle with the lowest temperature of a washing liquid. In another example, the washware treatment cycle may be chosen based on the amount of energy required to execute the washware treatment cycle. The washware treatment cycle associated with the least energy consumption may be chosen in order to increase the energy efficiency of the dishwasher. Furthermore, if the rack is loaded with a mix of different washware, some washware in the rack may require a more gentle washware treatment cycle than others. For example, if the rack is loaded with a crystal glass, this crystal glass may require a special treatment not to be destroyed during the washware treatment cycle. Therefore, the choice of washware treatment cycle may be based on the identified washware in the rack needing the most gentle washware treatment cycle. In one example, a gentle washware treatment cycle means the washware treatment cycle with the lowest temperature of the washing liquid. In another example, the most gentle washware treatment cycle is the washware treatment cycle with the shortest time duration of the washware treatment cycle. Moreover, a gentle washware treatment cycle may mean the cycle with the lowest temperature of the drying medium, the lowest temperature of the rinsing liquid, the least amount of detergent, or the lowest amount of washing liquid. This embodiment is advantageous in that it ensures that the most sensitive washware in the cavity is treated in a suitable way, rather than the other way around, since that would increase the risk of a washware being destroyed. Sensitive may in this context mean that the washware may not tolerate high temperatures, or a large amount of detergent, for example. Also, the typical load of a dishwasher may not be a uniform load, i.e. being loaded with a plurality of the same washware. Thus, the present embodiment is further advantageous in that it yields a more flexible dishwasher suited for real life applications.

It is noted that other embodiments using all possible combinations of features recited in the above described embodiments may be envisaged. Thus, the present disclosure also relates to all possible combinations of features mentioned herein. Any embodiment described herein may be combinable with other embodiments also described herein, and the present disclosure relates to all combinations of features.

BRIEF DESCRIPTION OF THE DRAWINGS

Exemplifying embodiments will now be described in more detail, with reference to the following appended drawings.

DETAILED DESCRIPTION

Figures 1A, 1B:
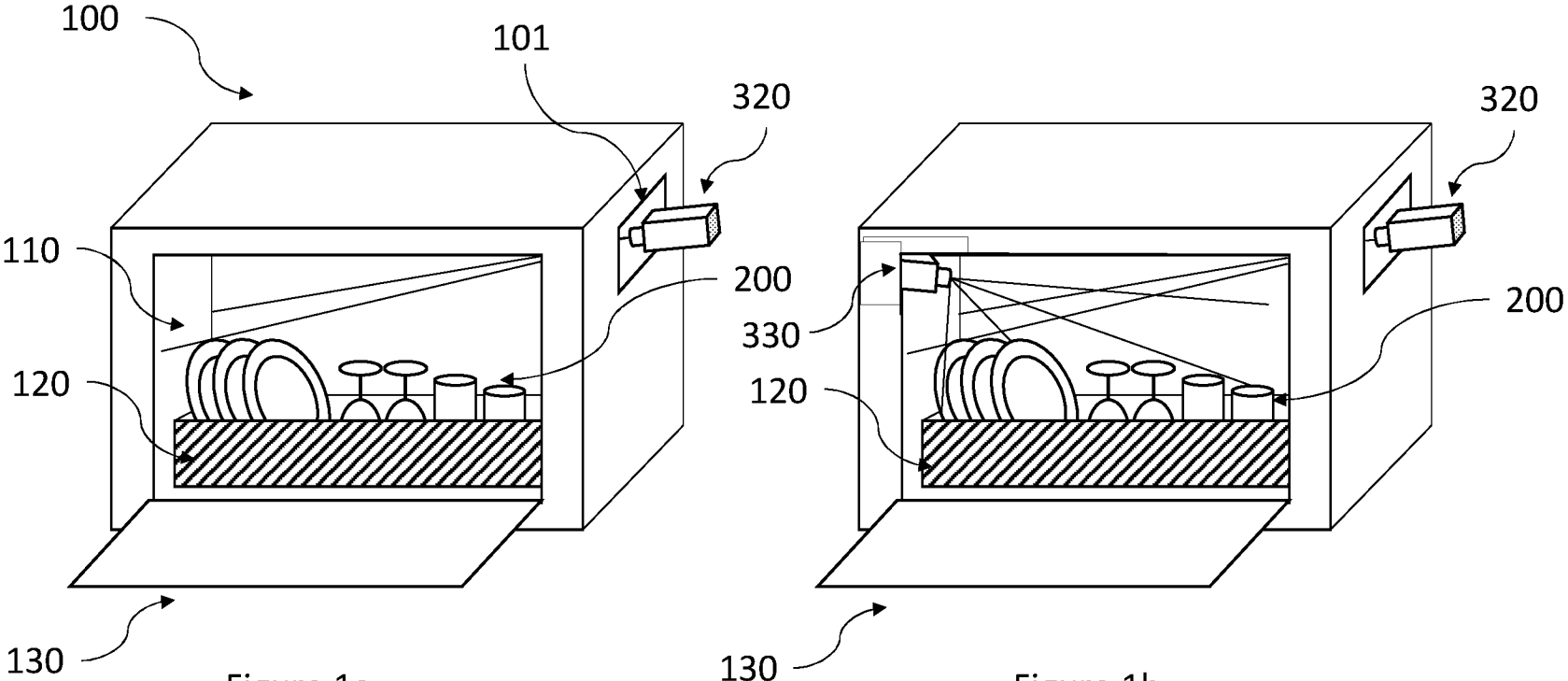
FIGS. 1*a-b* illustrates a perspective view of a dishwasher according to the present invention.

As illustrated in the figures, the sizes of the elements and regions may be exaggerated for illustrative purposes and, thus, are provided to illustrate the general structures of the embodiments. Like reference numerals refer to like elements throughout.

Exemplifying embodiments will now be described more fully hereinafter with reference to the accompanying drawings, in which currently preferred embodiments are shown. The invention may, however, be embodied in many different forms and should not be construed as limited to the embodiments set forth herein; rather, these embodiments are provided for thoroughness and completeness, and fully convey the scope of the invention to the skilled person.

With reference to FIG. 1*a* a dishwasher 100 according to an embodiment of the present invention is disclosed. The dishwasher 100 is configured to treat washware 200. The dishwasher 100 may for example be a dishwasher intended for use in professional kitchen environments, such as in restaurants, schools, or similar. The dishwasher 100 may also be a dishwasher 100 intended for private use. The washware 200 may for example be plates, glasses, mugs, pots and pans. The dishwasher 100 comprises a washing cavity 110 configured to receive the washware 200. Further, inside the washing cavity 110 there is a rack 120 in which the washware 200 is loaded. The rack 120 is removably inserted into the washing cavity 110 such that it can be inserted or extracted by a user wishing to load the rack 120 with washware 200 or empty the rack 110 from washware 200. The rack 110 may for example be arranged on wheels or guiding rails (not shown) for insertion and extraction from the washing cavity 110.

The washing cavity 110 is closed by a closing 130. In the embodiment illustrated in FIG. 1*a*, the closing 130 is a door. In other embodiments, the closing 130 may for example be a type of curtain. The closing 130 is configured to being switchable between two states, an open state configured to provide access to the washing cavity 110 and a closed state configured to close the washing cavity 110. FIG. 1*a* illustrates the closing 130 in the open state. Access is thus provided to the washing cavity 110 through an opening in the dishwasher 100. The closing 130 may be moved between the two states using by for example arranging the closing 130 on the dishwasher 100 using hinges. A user may then open and close the closing 130 by folding the closing 130 to cover the opening in the dishwasher 100 (closed state) or folding the closing 130 to uncover the opening in the dishwasher 100 (open state).

The dishwasher 100 further comprises a first image capturing device 320 configured to capture at least one first image of the washware 200 in the rack 120. The first image capturing device 320 may for example be a type of camera, such as a camera taking pictures in the visible light spectrum or the infrared light spectrum. The first image capturing device 320 is arranged in the dishwasher 100 such that its field of view includes the washware 200 in the rack 120. With field of view is herein meant the area across which the image capturing device can image. In the embodiment shown in FIG. 1*a*, the first image capturing device 320 is arranged on a side of the dishwasher 100, on an outside of the washing cavity 110. The dishwasher 100 may comprise a window 101 where the first image capturing device 320 can visibly access the washing cavity 110. The first image capturing device 320 may be mounted on the dishwasher 100 or on a surface nearby, and oriented in a way that allows the washing cavity 110 into its field of view.

With reference to FIG. 1*b* a dishwasher 100 according to an embodiment of the present invention is disclosed. The dishwasher 100 comprises a second image capturing device 330 configured to capture at least one second and at least one third image of the washware 200 in the rack 120. The second image capturing device 330 may for example be a type of camera, such as a camera taking pictures in the infrared light spectrum. The second image capturing device 330 is arranged inside the washing cavity 110 such that its field of view includes the washware 200 in the rack 120. In the embodiment shown in FIG. 1*b*, the second image capturing device 330 is arranged in a corner of the washing cavity 110. The second image capturing device 330 may be arranged in a different position than illustrated in the present figure. For example, the second image capturing device 330 may be mounted in any of the top corners of the washing cavity 110. The second image capturing device 330 may also be mounted on an inside wall of the washing cavity 110. In another example, the first and/or the second image capturing devices 320, 330 may be mounted on the closing 130 of the dishwasher 100.

Furthermore, the first image capturing device 320 and the second image capturing device 330 may be the same image capturing device. Thus, the first image capturing device 320 as illustrated in FIG. 1*a* may comprise both the first and second image capturing devices 320, 330. Similarly, the second image capturing device 330 as illustrated in FIG. 1*b* may comprise both the second and the first image capturing devices 320, 330. The image capturing device may be a camera suitable for capturing images in both the visible light spectrum and the infrared light spectrum.

Figure 2B:
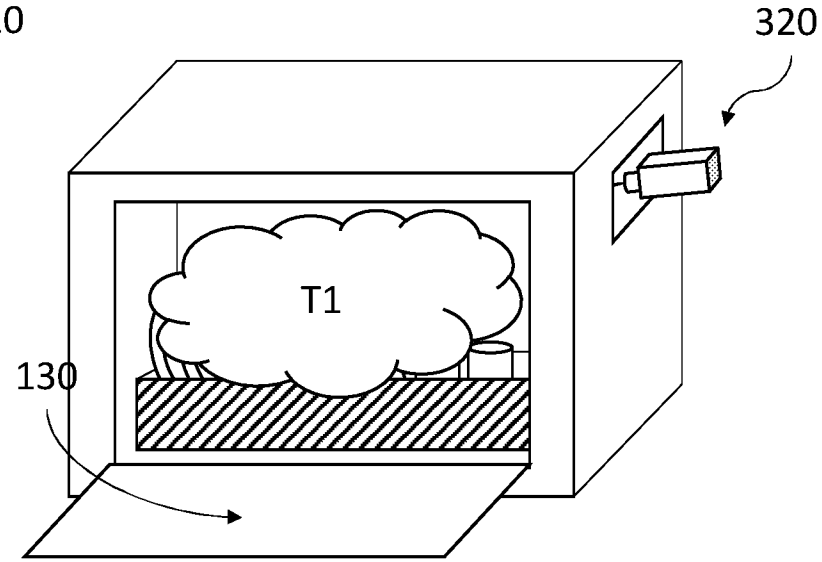
FIGS. 2*a-b* illustrates a perspective view of a dishwasher according to the present disclosure, comprising a closing.
Figure 2A:
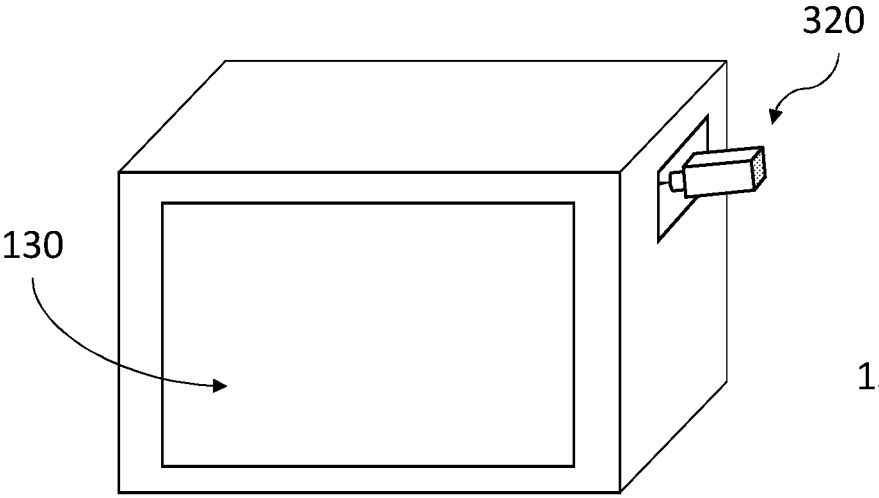

With reference to FIG. 2*a*, a dishwasher 100 according to an embodiment of the present invention is disclosed. The dishwasher 100 is shown with the closing 130 in the closed state. The dishwasher may further comprise a lighting device (not shown) configured to at least partly illuminate the washing cavity 110. The lighting device may illuminate the washing cavity 110 regardless of the state of the closing 130. In another example, the lighting device may only illuminate the washing cavity 110 in a closed state of the closing 130.

With reference to FIG. 2*b*, a dishwasher 100 according to an embodiment of the present invention is disclosed. The embodiment in the present figure illustrates a washing cavity 110 wherein the washware 200 is subject to being heated with a predetermined temperature T1. The heating of the washware 200 in the rack 120 is performed using a heating medium (not shown) at a predetermined temperature T1, for a predetermined amount of time. The heating medium may be steam, hot water or hot air having the predetermined temperature T1. In the present figure the closing 130 is in an open state while the heating medium is heating the washware 200 in the washing cavity 120. In a preferred embodiment the closing 130 is in a closed state when the heating medium heats the washware 200. The above FIG. 2*b* is included for illustrative purposes.

With reference to FIG. 3*a-d*, four racks 120 loaded with washware 200 according to exemplifying embodiments of the present invention are disclosed. The present figures are meant to provide examples of how a rack 120 may be loaded with washware 200 by a user of the dishwasher 100. The racks 120 shown in the figures are shown from a side view. The racks 120 are rectangular from a side view, with a length L and a height H. The racks 120 may have four sides having the same lengths L and heights H. Furthermore, the racks 120 may be standard racks used for dishwashers, and their shape may conform with an interior of the dishwasher 100, or washing cavity 110.

Figure 3A:
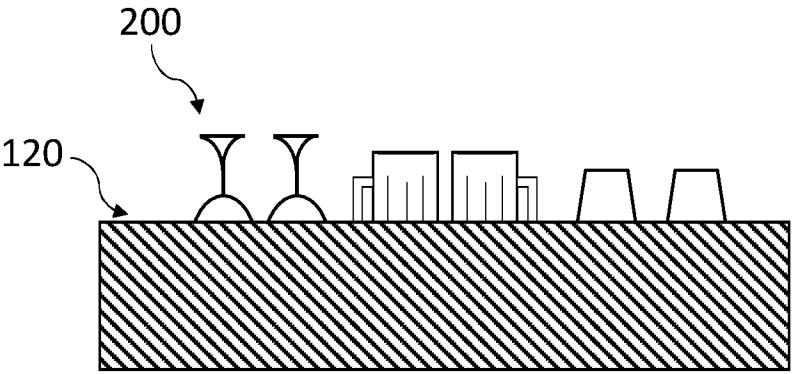
FIGS. 3*a-d* illustrates schematic views of a rack loaded with washware according to the present invention.

With reference to FIG. 3*a*, a rack 120 is shown, loaded with washware 200. The washware 200 in this case consists of different types of glasses. The rack 120 is loaded with a uniform load since it is only loaded with glasses. However, the rack 120 could also be considered to have a mixed load since the types of glasses are different. The glasses may for example be wine glasses, beer glasses, water glasses, coffee cups, mugs, etc. Furthermore, the material of the glasses may vary. The materials may for example be glass with different thicknesses, plastic, ceramics, porcelain, etc.

Figure 3B:
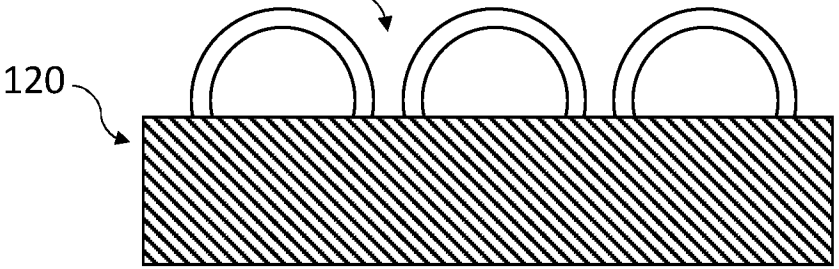

With reference to FIG. 3*b*, a rack 120 is shown, loaded with washware 200. The washware 200 in this case consists of plates. The rack 120 is thus loaded with a uniform load. The material of the plates may vary. The materials may for example be porcelain, glass, plastic, ceramics, etc.

Figure 3C:
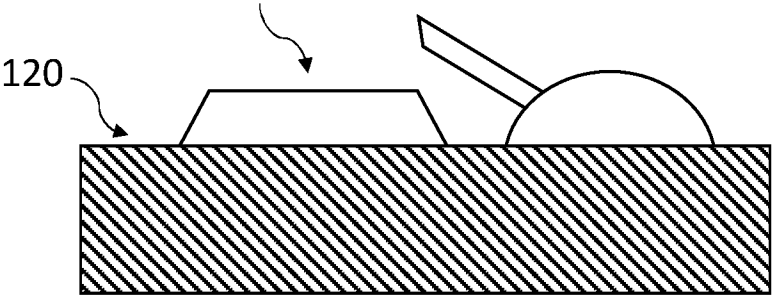

With reference to FIG. 3*c*, a rack 120 is shown, loaded with washware 200. The washware 200 in this case consists of cookware. The rack 120 is loaded with a uniform load since it is only loaded with cookware. However, the rack 120 could also be considered to have a mixed load since the types of cookware are different. The cookware may for example be pots, frying pans, saucepan, skillets, etc. The material of the plates may vary. The materials may for example be stainless steel, steel, iron, aluminum, a metal with a Teflon coating, etc.

Figure 3D:
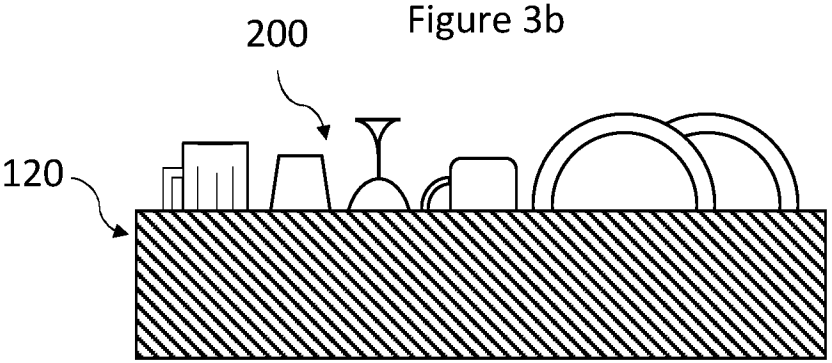

With reference to FIG. 3*d*, a rack 120 is shown, loaded with washware 200. The washware 200 in this case consists of a mix of different types of washware. The rack 120 is thus loaded with a mixed load since it is loaded with a mix of different types of washware 200. The washware 200 may for example be glasses, cookware, plates, etc. The material of the washware 200 may vary. The materials may for example be glass, ceramics, plastic, porcelain, stainless steel, steel, iron, aluminum, a metal with a Teflon coating, etc.

Figure 4:
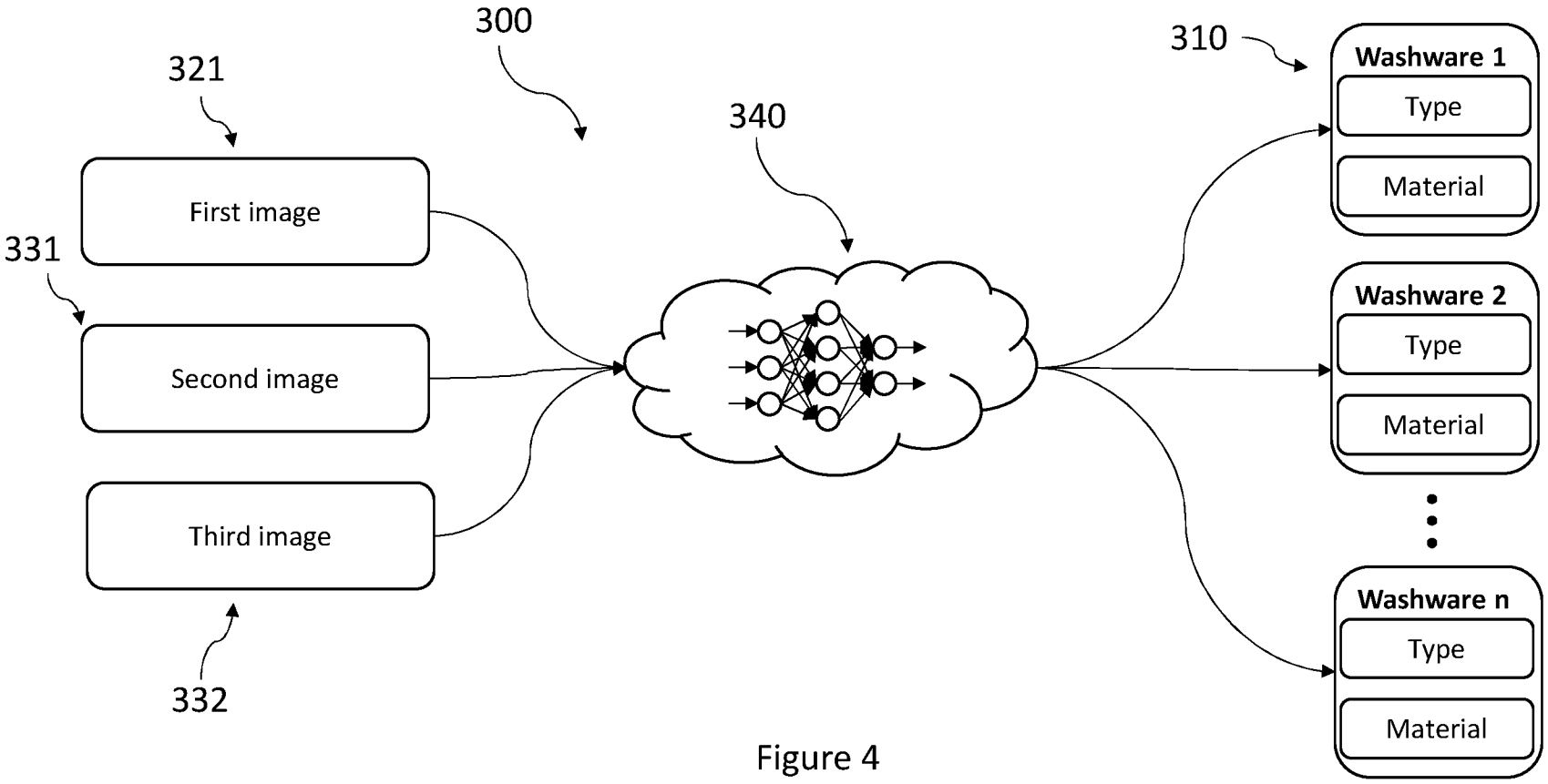
FIG. 4 illustrates a schematic view of a washware recognition system according to the present invention.

With reference to FIG. 4, a schematic view of an washware recognition system 300 according to the present invention is disclosed. The washware recognition system 300 comprises a first and a second image capturing device (not shown in this figure), and a neural network 340. The at least first 321, second 331, and third 332 images captured by the first and second image capturing devices 320, 330, are fed as input to the neural network 340 (NN). As mentioned, the at least one first 321 image is represented in the visual light spectrum. The at least one second 331 and third images 332 are represented in an infrared light spectrum. The NN 340 may be an artificial neural network, a convolutional neural network or a recurrent neural network, for example. Other types of machine learning models, deep learning models or other image recognition models are possible. The NN 340 may have one or several layers of nodes. For example, as illustrated in FIG. 4, the NN 340 has an input layer, a middle layer and an output layer. The input layer consists of three nodes, representing the three images 321, 331, 332. The middle layer may have a different number of nodes depending on which algorithm that is chosen to build the NN 340. The output layer has two nodes, one for each washware characteristics 310. Thus, one output node is representing the type of washware 200 classified by the NN 340, and the other one is representing the material of the washware 200 classified by the NN 340. The NN 340 thus analyzes the mentioned images to classify the washware 200 loaded in the rack 120. The at least one first and second images 321, 331 are captured images of the rack 120 when the rack 120 has been loaded with the desired washware 200. The at least one third 332 image is captured after the heating operation has been performed in the washware cavity 110. All three types of images 321, 331, 332 are fed as input to the NN 340, which classifies the current load in the rack 120, and a washware characteristics 310 is output for each washware 200 in the rack 120. If the number of washware 200 loaded in the rack 120 are n, the NN 340 will output a washware characteristics 310 for each washware 200, thus 2×n (or two multiplied by n), since the washware characteristics 310 includes two parameters, type and material. The choice of NN 340 or algorithm of the NN 340 is not part of the invention, and will not be described in more detail.

Figure 5:
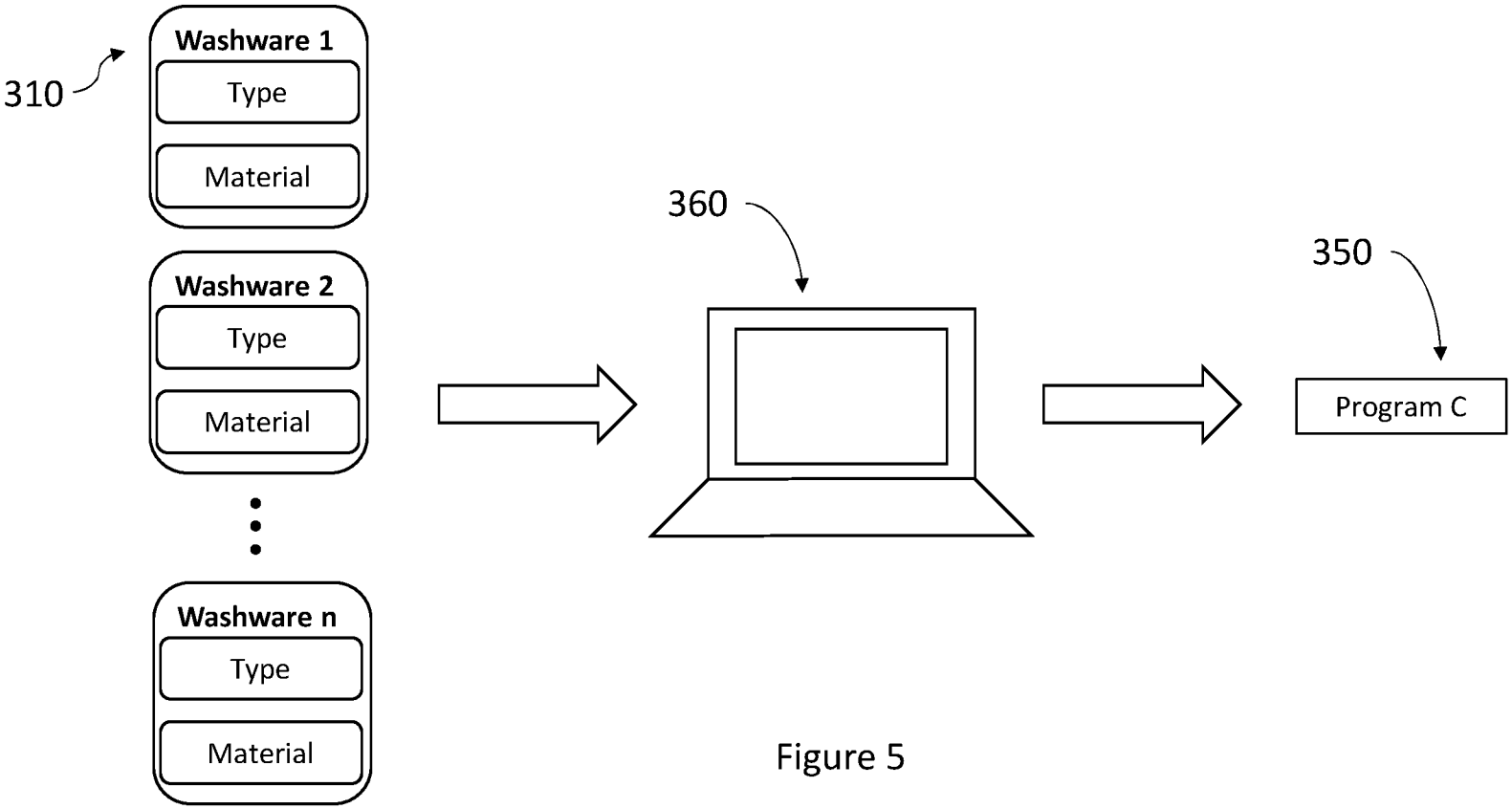
FIG. 5 illustrates a schematic view of a control unit according to the present invention.

With reference to FIG. 5, a schematic view of a control unit 360 according to the present invention is disclosed. The output from the NN 340, i.e. the washware characteristics 310 of the washware 200 loaded in the rack 120 is fed to the control unit 360 of the dishwasher 100. The control unit 360 evaluates the washware characteristics 310 and determines a washware treatment cycle 350 based thereon. The control unit 360 may have prior knowledge of the most optimal washware treatment cycle 350 for a certain mix of washware 200, i.e. washware characteristics 310. A user does thus not have to be involved in determining the washware treatment cycle 350. For example, as illustrated in the present figure, washware treatment cycle 350 "Program C" is chosen. "Program C" may for example be a program suitable for a uniform load with cookware made of metal.

Figure 6:
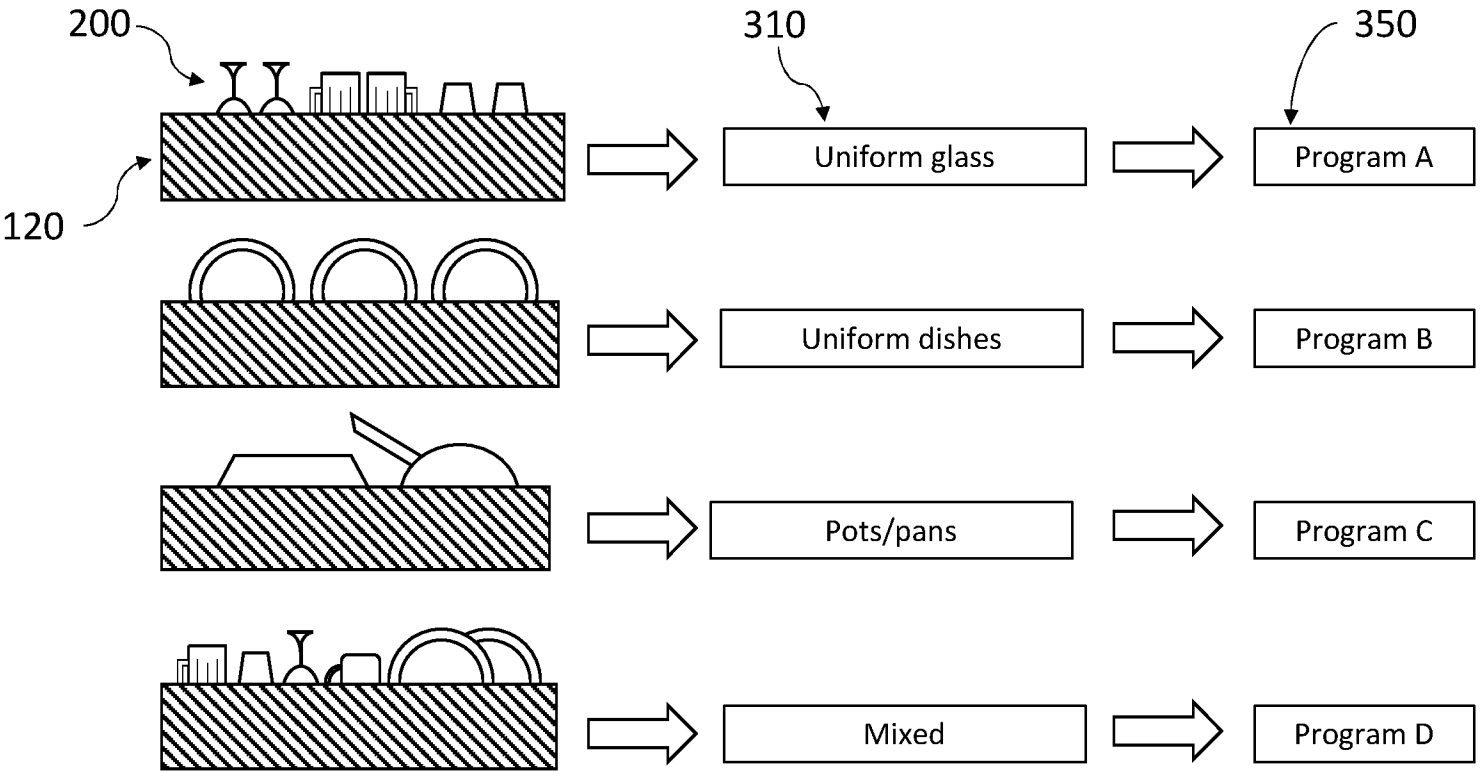
FIG. 6 illustrates a schematic view of exemplifying washware classifications according to the present invention.

With reference to FIG. 6, a schematic view of examples of washware classifications 310 and their corresponding washware treatment cycles 350 according to the present invention is disclosed. The load in the racks 120 from FIGS. 3*a-d* are chosen as examples. Thus, a rack 120 loaded with different types of glasses, is classified by the NN 340 and the washware characteristics 310 show that the rack 120 is loaded with glasses made of glass and plastic, for example. The control unit 360 then determines to treat the washware 200 with the washware treatment program 350 "Program A", which may be designed to suit washware 200 having those washware characteristics 310. Similarly, a rack 120 loaded with a uniform load of plates, is classified by the NN 340 and the washware characteristics 310 show that the rack 120 is loaded with plates made of porcelain, for example. The control unit 360 then determines to treat the washware 200 with the washware treatment program 350 "Program B", which may be designed to suit washware 200 having those washware characteristics 310. Again similarly, a rack 120 loaded with a mixed load of washware 200, is classified by the NN 340 and the washware characteristics 310 show that the rack 120 is loaded with plates, glasses and cookware with the materials glass, plastic, porcelain and metal, for example. The control unit 360 then determines to treat the washware 200 with the washware treatment program 350 "Program D", which may be designed to suit washware 200 having those washware characteristics 310.

Figure 7:
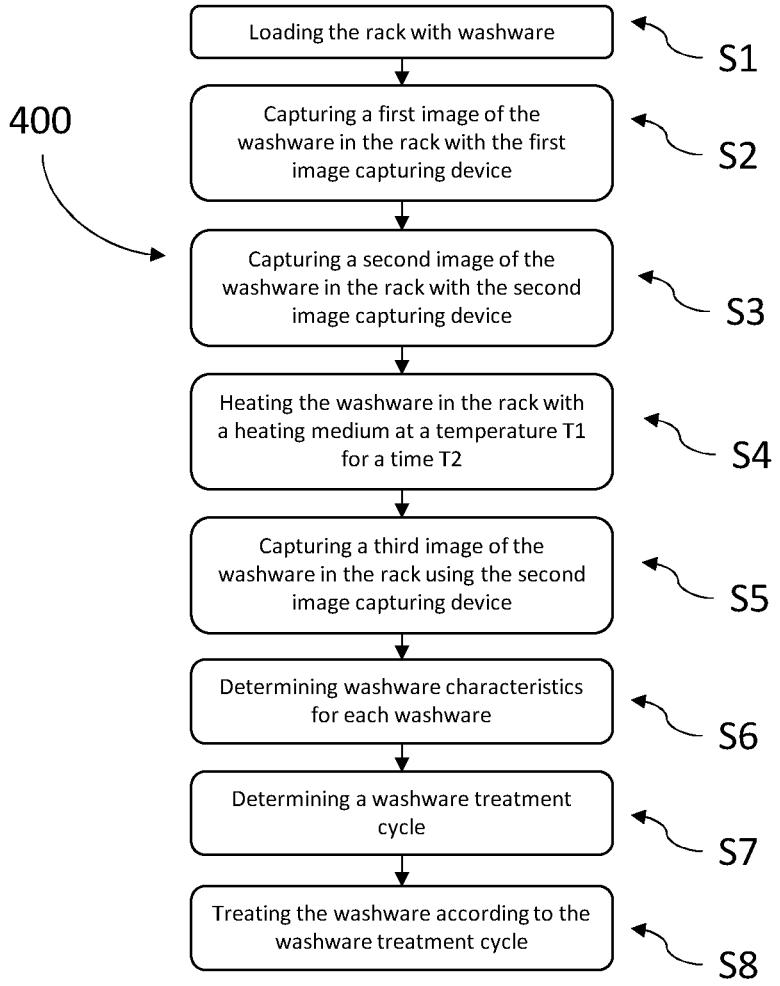
FIG. 7 illustrates a schematic view of a method for treating the washware in the dishwasher according to the present invention.

With reference to FIG. 7, a schematic view of a method 400 for treating the washware 200 in the dishwasher 100 according to the present invention is disclosed. The method 400 comprises a step S1 of loading the rack 120 with washware 200. The loading of washware 200 into a rack 120 may be performed manually by a user or automatically. The present step S1 may also include indicating that the dishwasher 100 should start to clean the washware 200 in the rack 120. This may for example be performed by a user shutting the washing cavity 110 by closing the closing 130, and indicating a desire to start a washware treatment cycle 350. This may for example be performed by pressing a "start" button on the dishwasher 100, or similar.

The method 400 further comprises the step S2 of capturing a first image 321 of the washware 200 in the rack 120 with the first image capturing device 320. The first image capturing device 320 may be programmed to automatically capture an image in connection with the dishwasher 100 being started, or for example by a user pressing a button to indicate a desire to start a washware treatment cycle 350. If there is a lighting device inside the washing cavity 110, this may also be connected to the same button, and turned on in connection to the first image 321 being captured. The lighting device may also be connected to the first image capturing device 320, for example, the lighting device may be a flash incorporated in the first imaging device 320. The first image 321 is captured in the visible light spectrum.

The method 400 further comprises the step S3 of capturing a second image 331 of the washware 200 in the rack 120 with the second image capturing device 330. The second image capturing device 330 may be programmed to automatically capture an image in connection with the dishwasher 100 being started, or for example by a user pressing a button to indicate a desire to start a washware treatment cycle 350. Furthermore, the second image capturing device 330 may be programmed to capture the second image 331 immediately following the capturing of the first image 321. Even further, the first image capturing device 320 and the second image capturing device 330 may be the same device. The second image 331 is captured in the infrared light spectrum.

The method 400 further comprises the step S4 of heating the washware 200 in the rack 120 with a heating medium (not shown) at a temperature T1 for a time T2. The heating operation may start after the second image 331 has been captured. The temperature T1 may for example be set by the control unit 360, and may be the same temperature regardless of the washware characteristics 310 of the washware 200. The temperature T1 may for example be between 70-95 degrees Celsius. The time T2 may also be set by the control unit 360. Further, the time T2 may be the same amount of time regardless of the washware characteristics 310 of the washware 200. The time T2 may for example vary between 1-10 minutes.

The method 400 further comprises the step S5 of capturing a third image 332 of the washware 200 in the rack 120 using the second image capturing device 330. The second image capturing device 330 may be programmed to automatically capture a third image 332 in connection with the heating operation being finished. For example, the second image capturing device 330 may capture the third image 332 after the time T2 has passed. The third image 332 is captured in the infrared light spectrum.

The method 400 further comprises the step S7 of determining a washware treatment cycle 350. The washware treatment cycle 350 is determined based on the output from the neural network 340. The output from the neural network 340 comprises information regarding the washware characteristics 310 of the washware 200 loaded in the rack 120. The neural network 340 uses the first, second and third images 321, 331, 332 as input. The control unit 360 determines the washware treatment cycle 350 best suited for the current washware 200 loaded in the rack 120. The control unit 360 may further be programmed to automatically determine and start a washware treatment cycle 350 as soon as it receives the output from the neural network 340. The user of the dishwasher 100 does not therefore need to be involved in choosing a washware treatment cycle 350.

The method 400 further comprises the step S8 of treating the washware 200 according to the washware treatment cycle 350. As previously mentioned, the control unit 360 may be programmed to automatically choose and start the selected washware treatment cycle 350 after receiving the output from the neural network 340, which includes the washware characteristics 310 of the washware 200 in the rack 120. The control unit 360 may have a selection of predetermined washware treatment cycles 350 stored in its memory. The washware treatment cycle 350 may include variable parameters, such as a time duration of the washware treatment cycle, a temperature of a washing liquid, a temperature of a rinsing liquid, a temperature of a drying medium, a time duration of a drying cycle, an amount of detergent, and an amount of washing liquid. The variable parameters may vary depending on the washware characteristics 310. Further, the user of the dishwasher 100 may be notified when the washware treatment cycle 350 is finished. The notification may for example be a light shining in a certain color on the dishwasher 100, a sound notification from the dishwasher 100, or similar.

The invention claimed is:

1. A method (400) for treating washware (200) using a dishwasher (100) for treating washware, comprising: a washing cavity (110) configured to receive washware (200); a rack (120) removably inserted in the washing cavity (110), and configured to hold said washware (200); a washware recognition system (300) configured to detect a washware characteristics (310) for each washware (200) in the washing cavity (110), the washware recognition system (300) comprising a first image capturing device (320) capturing at least one first image (321) of the washware in the rack (120), a second image capturing device (330) capturing at least one second image (331) and at least one third image (332) of the washware (200) in the rack (120), a neural network (340), NN, configured to, based on the at least one first (321), second (331) and third images (332), determine a washware characteristics (310); and a control unit (360) configured to evaluate the washware characteristics (310) and determine a washware treatment cycle (350) based on the washware characteristics (310), the method comprising:

a. loading the rack (120) with washware (200);

b. capturing at least one first image (321) of the washware (200) in the rack (120) using the first image capturing device (320);

c. capturing at least one second image (331) of the washware (200) in the rack (120) using the second image capturing device (330);

d. heating the washware (200) in the rack (120) using a heating medium at a predetermined temperature (T1) for a predetermined amount of time (T2);

e. capturing at least one third image (332) of the washware (200) in the rack (120) using the second image capturing device (330);

f. determining washware characteristics (310) based on the at least one first image, the at least one second image, and the at least one third image;

g. determining, based on the washware characteristics (310), a washware treatment cycle (350); and h. treating the washware (200) in the washing cavity (110) according to the determined washware treatment cycle (350).

2. The method (400) according to claim 1, wherein the washware characteristics (310) comprises information about a type of the washware (200).

3. The method (400) according to claim 1, wherein the washware characteristics (310) further comprises information about a material of the washware (200).

4. The method (400) according to claim 1, wherein the washware treatment cycle (350) comprises a set of parameters determined by the control unit (360), the parameters including at least one of the following:

a time duration of the washware treatment cycle;
a temperature of a washing liquid;
a temperature of a rinsing liquid;
a temperature of a drying medium;
a time duration of a drying cycle;
an amount of detergent; and
an amount of washing liquid.

5. The method (400) according to claim 4, wherein the washware (200) in the rack (120) is a plurality of washware (200) having different washware characteristics (310), and wherein the washware treatment cycle (350) is determined based on the washware characteristics (310) associated with the washware treatment cycle (350) with the lowest temperature of a washing liquid.

6. The method (400) according to claim 1, wherein the heating medium in step d is water or air being supplied to the washing cavity (110) for the predetermined amount of time (T2), the water or air having the predetermined temperature (T1).

7. The method (400) according to claim 1, wherein the washware characteristics (310) is at least partly determined based on a temperature increase of each heated washware (200) in the rack (120), as a result of step d.

8. The method (400) according to claim 7, wherein the temperature increase is determined by comparison of the at least one second image (331) from step c and the at least one third image (332) from step e.

* * * * *